United States Patent [19]

Heaston et al.

[11] Patent Number: 4,524,547

[45] Date of Patent: Jun. 25, 1985

[54] AUTOMATIC DOUBLE DISC GRINDER CONTROL CYCLE

[75] Inventors: Gaylord E. Heaston, Beloit, Wis.; Edward A. Farazandeh, Aurora, Ill.

[73] Assignee: Litton Industrial Products, Inc., South Beloit, Ill.

[21] Appl. No.: 529,625

[22] Filed: Sep. 6, 1983

[51] Int. Cl.[3] ..... B24B 49/18

[52] U.S. Cl. ..... 51/165.77; 51/111 R; 51/165.87

[58] Field of Search ..... 51/165 R, 111 R, 165.87, 51/165.88, 5 D, 165.77

[56] References Cited

U.S. PATENT DOCUMENTS

| | | | |
|---|---|---|---|
| 3,885,353 | 5/1975 | Ota | 51/165.87 |
| 3,973,433 | 8/1976 | Pozzetti | 51/165.88 |
| 3,975,864 | 8/1976 | Glowacki | 51/165.87 |
| 4,020,601 | 5/1977 | Gray | 51/165.87 |
| 4,213,277 | 7/1980 | Fivian | 51/165.88 |
| 4,217,734 | 8/1980 | Frei | 51/165.88 |
| 4,420,910 | 12/1983 | Lorsson | 51/165.88 |

*Primary Examiner*—Harold D. Whitehead
*Attorney, Agent, or Firm*—Spencer T. Smith

[57] ABSTRACT

A surface grinding machine comprises a wheelhead assembly including an abrasive disc having a flat stock removal surface and a means for supporting the wheelhead assembly for movement in an axial direction. A microprocessor controller defines a selected infeed program for the wheelhead assembly having at least an initial infeed distance, and an initial feed rate, and a finish infeed distance at a finish feed rate less than said initial feed rate. The microprocessor controller additionally changing the axial location of said retracted and finish positions in response to attrition of the abrasive disc caused by workpiece grinding and disc dressing.

2 Claims, 8 Drawing Figures

AUTOMATIC DOUBLE DISC GRINDER CONTROL CYCLE

BACKGROUND OF THE INVENTION

The present invention relates to an automatic cycle control for a surface grinding machine in which grinding wheel attrition caused by grinding and dressing operations are automatically compensated for and used to adjust subsequent grinding and dressing cycles.

Surface grinding machines in which the face of a grinding wheel is advanced into forceful engagement with a workpiece are well known in the art. The grinding operation which removes stock material from the workpiece also necessarily wears down the abrasive surface of the grinding disc. In precision grinding operations this loss of the grinding disc material must be taken into account when advancing the discs into the workpiece in order to insure that consecutive workpieces will be finish ground to the same size. This compensation requires constant intervention by a machine operator; or in the past, has been performed by assuming a fractional loss of the grinding disc with each grinding operation and adjusting the infeed of the grinding disc accordingly. Such assumptions are not always completely accurate and consequently require periodic workpiece sizing and further compensation of the grinding machine cycle.

In order to maintain the desired flat profile of the grinding disc when grinding successive workpieces, periodic dressing operations are performed in which a diamond tool is used to dress the face of the disc. This dressing operation is time consuming since the disc has to be accurately positioned with respect to the diamond dressing tool in order to obtain a satisfactory dress. Subsequent grinding operations require an adjustment of the infeed control of the disc assemblies since the thickness of the grinding disc measured in the direction of the grinding disc infeed is reduced.

Consecutive grinding cycle parameters may be controlled by a program which relies on assumed relationships, but such control is not completely accurate because of variations in grinding disc and workpiece physical characteristics. If the grinding disc wears faster than anticipated, the result may be a number of finish ground workpieces which are oversized. If the grinding discs do not wear as quickly as anticipated, the infeed control of the oversized discs can result in workpieces being finished undersize, or the tooling which holds the workpiece being ground by the grinding wheel.

OBJECTS OF THE INVENTION

It is accordingly an object of the invention to provide an automatic cycle control for a surface grinding machine.

It is another object of the invention to provide an automatic cycle control for a surface grinding machine wherein actual grinding disc attrition through grinding or through dressing operations is sensed and used to alter the grinding machine cycle.

These and other objects of the invention will become apparent from the following detailed description taken in conjunction with the accompanying drawing figures in which like reference numerals designate like or corresponding parts throughout the figures.

DESCRIPTION OF THE PREFERRED EMBODIMENT

Figure 1:
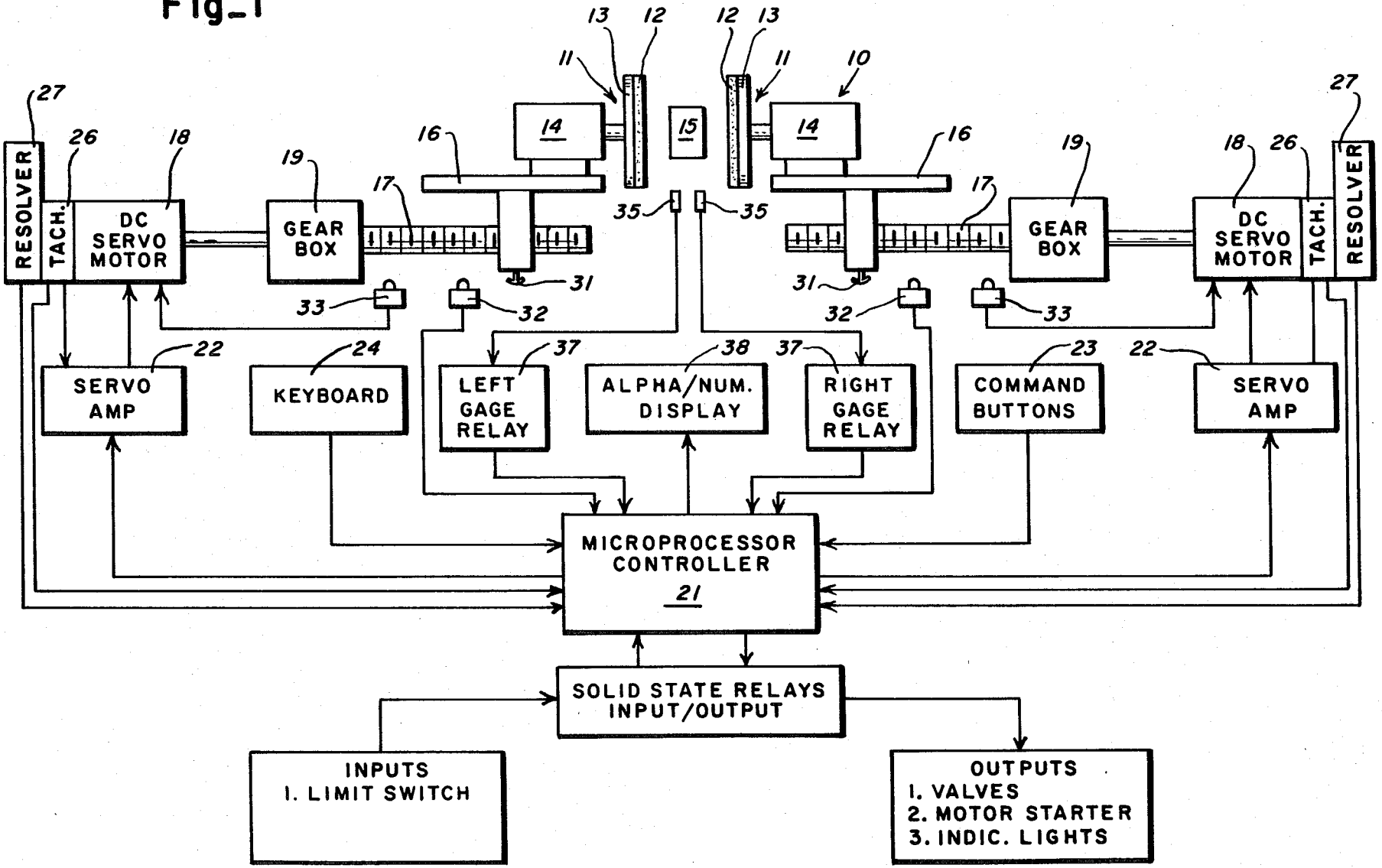
FIG. 1 shows a grinding machine and associated controls according to the present invention.

Referring to FIG. 1, there is shown a double disc grinding machine and control apparatus generally designated by the reference numeral 10. A double disc grinding machine is a type of surface grinder in which opposed grinding discs are used to simultaneously grind parallel surfaces on opposite sides of a workpiece. As will be apparent to those skilled in the art, the principles of the present invention may be applied to either single or double disc surface grinders.

The double disc grinder comprises two wheelhead assemblies 11 each including an abrasive disc 12 and a spindle 13 which are driven by a motor 14. The wheelhead assemblies 11 and motors 14 are mounted on supports 16 which are mounted for axial movement on drive screws 17. The infeed and retraction of each support 16 is effected by a DC motor 18 coupled to the drive screws 17 through a gear box 19.

A microprocessor controller 21 is used to control the DC servo motor 18 through a servo amplifier 22. Microprocessor controllers themselves are commercially available and in the preferred embodiment, an 8 bit microprocessor based on the Motorola 6800 microprocessor family is used. Inputs to the controller 21 may be made by command buttons 23 which may be, for example, an on/off switch, a start cycle switch or a stop cycle switch, and by machine inputs such as limit and float switches applied through solid state relays 20. Additional inputs are provided by a keyboard 24 which is used to input grind and dress cycle parameters to the microprocessor controller. Such grind and dress cycle parameters may include the thickness of the grinding disc, the position of the spindle at the beginning of a grind cycle, the amount and rate of infeed applied to the disc during the grind cycle, the location of the grind line, and the position of the spindle during a dressing operation. The microprocessor 21 is coupled to machine elements such as valves, starters, and indicating lights through the solid state relays 20, and is additionally coupled to an alpha-numeric output display device 38 by means of which information can be indicated to an operator.

The rate of advance of the wheelhead assemblies 11 is controlled by the DC servo motors 18, the speed of which is sensed by a tachometer 26 which applies a signal to a servo amplifier 22. The servo amplifier 22 also receives the desired rate of advance for the wheelhead assembly 11 from the microprocessor controller 21 and applies a control signal to the DC servo motor 18 based upon the signal received from the microprocessor controller 21 and the tachometer 26. A reference position for the wheelhead assemblies 11 is established by a contact 31 mounted on the support 16 tripping a reference switch 32 mounted on the machine frame and feeding the signal developed by the switch 32 to the controller 21. Thereafter, the position of the wheelhead assemblies is known from signals developed at the resolver 27 which indicate the amount of rotation of the DC servo motor 18. Left and right rear limit switches 33 are positioned to be tripped by the contact 31 which are coupled directly to the DC servo motors 18 to limit the rearward travel of the supports 16 in the event of failure of the microprocessor controller 21.

Two gauges 35 are located in the space between the wheelhead assemblies 11 and are positioned to be contacted by the grinding discs 12 when the discs have ground the workpiece to finish size. The faces of the spindles 13 are then positioned at the grind lines GL. Accordingly, a grind line GL may be defined as the position of the face of the spindle 13 when the abrasive wheel 12 is in contact with the surface of the workpiece 15 which has been ground to finish size. Signals from the gauges 35 are received by gauge relays 37 and applied to the microprocessor 21.

Figure 2:
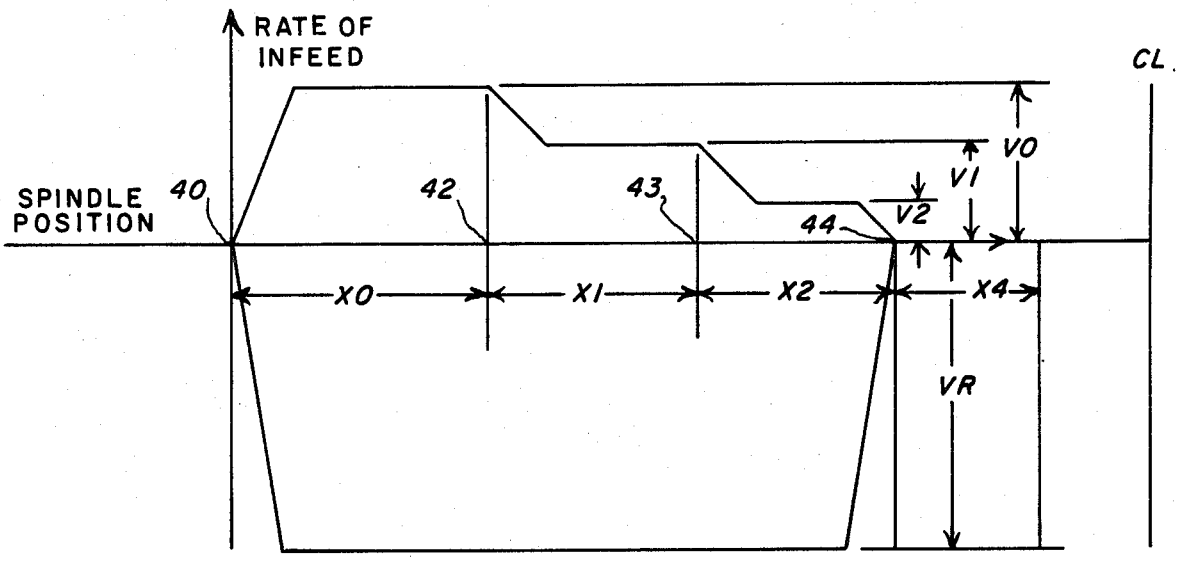
FIG. 2 shows the graphic profile of the motion of a grinding wheel during a grinding cycle.

FIG. 2 is a graphic profile of the motion of the grinding wheel related to the position of the face of the spindle 13. The position 40 represents the retracted position of the spindle 13 before the initiation of a grinding cycle. The infeed speed is rapidly increased until velocity $V_0$ is attained and this speed is maintained until the spindle has traversed distance X0 to reach position 42. Between position 40 and 42, the face of the grinding disc comes into contact with the workpiece 15 and initial grinding of the high spots existing on the workpiece begins. At position 42 the rate of infeed is decreased to V1, and the spindle is advanced a distance X1 until position 43 is reached. During this portion of the infeed cycle, additional material is ground from the workpiece. At position 43 the rate of infeed is reduced to V2 and the finish grinding of the workpiece through distance X2 is performed at this infeed rate. When the spindle reaches position 44 the workpiece has been ground to size by the disc 12 and no further infeed is required. Position 44 is also known as the grind line, GL, as defined above and more fully explained in conjunction with FIG. 3. The direction of infeed is then reversed and the spindle is driven at velocity VR to the initial position 40 in order to begin a new grinding cycle on a new workpiece. To insure that consecutive workpieces will exhibit identical finish ground surface characteristics, it is imperative that the same graphic profile be used to control the grinding machine through each grinding cycle.

DRESSING AND GRINDING OPERATIONS

Figure 3A:
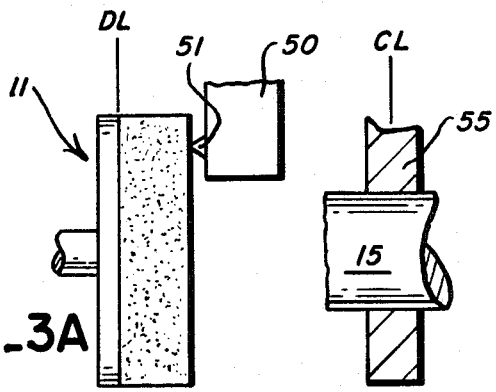
FIGS. 3A through 3F show the left side of a double disc grinding machine and a workpiece in various stages of a grinding machine cycle.

Referring now to FIG. 3A, the relative positions of a wheelhead assembly 11, a dressing tool 50, and the workpiece 15 are shown in greater detail. The dressing line DL represents that position to which the spindle of the wheelhead assembly must be withdrawn in order to initiate a dressing operation. The dressing arm 50 carries a diamond point dressing tool 51 and may be swung into the position shown to contact the face of the abrasive disc 12. The dressing arm 50 is not movable in a direction parallel to the axis of the wheelhead assemblies 11 and therefore the wheelhead assembly 11 must be correctly located with respect to the dressing arm 50 in order to carry out a dressing operation. The arm 50 may be swung in an arc so that the diamond point tool sweeps over the face of the rotating abrasive disc 12 in order to resurface the disc 12 leaving a flat grinding surface. Several passes of the dresser arm 50 may be required to properly dress the disc 12, and before each pass, the wheelhead assembly 11 is advanced slightly toward the center line CL so that the diamond point tool 51 takes a new cut.

Figure 3D:
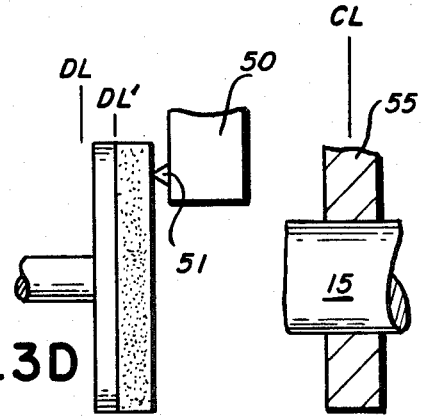
Figure 3B:
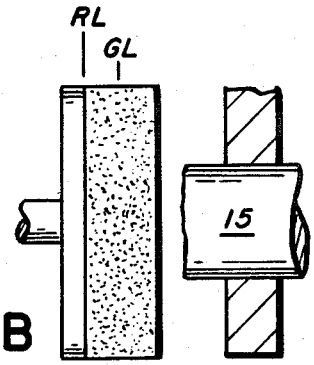
Figure 3E:
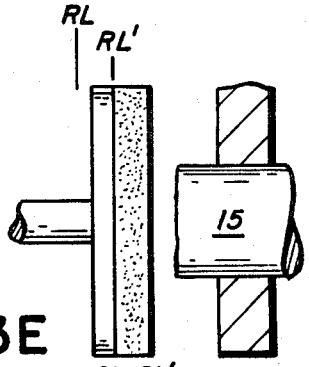
Figure 3C:
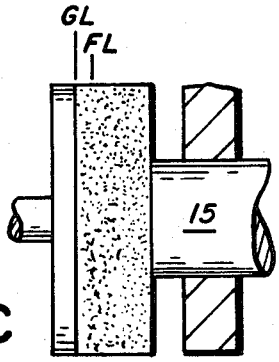
Figure 3F:
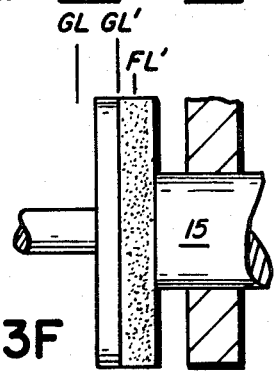

After the dressing operation has been completed, the wheelhead assembly is advanced until the face of the spindle is at position RL as shown in FIG. 3B. Position RL corresponds to position 40 of FIG. 2, and the wheelhead assembly is thereafter axially advanced and the rate of infeed is varied according to the graphic profile shown by FIG. 2 until the workpiece 15 has been ground and the spindle reaches the grind line GL as shown in FIG. 3C. The grind line GL corresponds to position 44 shown on FIG. 2.

After the grinding operation, the wheelhead assembly will be withdrawn to the retracted position RL (position 40 on FIG. 2) and a new workpiece 15 will be positioned by the workpiece holder on the wheelhead axis so that a new grind cycle may commence.

After a preselected number of grind cycles, the wheelhead assembly is once again moved to the position DL so that the grinding disc surface may be dressed by the dressing tool. After each grinding and dressing cycle, the abrasive disc is reduced substantially in thickness requiring the dressing line DL, the starting position RL, and the positions 42, 43 and 44 for the grinding profile of FIG. 2 to be updated.

REDEFINITION OF THE GRIND CYCLE BY THE MICROPROCESSOR CONTROLLER

The gauge 35 develops a signal each time the grinding wheel 12 reaches the grind line GL. During the infeed cycle, the microprocessor controller 21 receives signals from the resolver 2 indicating the actual distance the wheelheads are advanced. The signal from the gauge 35 stops the infeed cycle and the microprocessor compares the amount of infeed required for the abrasive disc to reach the grind line with the amount of infeed required on the previous cycle. If the grinding wheel has been worn causing additional infeed to be required, this additional amount of infeed is used to redefine the retract line RL. Accordingly, on the next grind cycle, the wheelhead is positioned at the newly defined retract line $RL^1$ shown in FIG. 3E, and the standard grinding program as defined by the profile of FIG. 2 is followed. In this way, the microprocessor controller 21 compensates the infeed program for grinding wheel wear. The same redefinition of the infeed program may be made by the microprocessor 21 if other types of gauging or workpiece size control are used in place of the gauge 35.

When a dress cycle is required, the dressing line DL is updated to $DL^1$ as shown in FIG. 3D. The difference between DL and $DL^1$ is an amount equal to the amount the retract line RL has advanced since the last dressing cycle. This causes the face of the grinding wheel to be correctly positioned with respect to the dressing tool to compensate for wheel attrition due to grinding. Additionally, with each pass of the dressing arm across the face of the abrasive disc, the amount of input feed applied to the disc in order accomplish the dressing operation is measured by the resolver and supplied to the microprocessor controller. Using this dressing infeed information, the retract line RL is updated in order to compensate for wheel attrition due to dressing.

SAFETY FEATURES

The abrasive disc itself is attached to the wheelhead spindle by means of bolts (not shown) which are imbedded in the rear surface of the disc. The usable thickness of the abrasive disc material can be input through the keyboard 24 into the microprocessor controller at the time the disc is first mounted on the spindle 13. Each time abrasive disc material is lost either through a grinding operation as detected by the gauge 35, or through a dressing operation, the usable thickness of the abrasive disc can be updated in the microprocessor controller. Thus, as the remaining usable thickness of the disc approaches zero, the microprocessor can stop operation of the grinder and indicate to an operator by means of the alpha-numeric 38 display that disc replacement is needed. This feature precludes the possibility that grinding and dressing cycles repeat until no usable grinding disc remains and the workpiece is contacted by the bolts which hold the grinding disc to the spindle.

A second safety feature can be built into the machine to provide for machine shutdown in the event that the gauge 35 should fail. The microprocessor controller can be programmed with an infeed distance X4 measured from the grind line GL to a feed limit position FL. When the spindle 13 is at position FL, the face of the abrasive disc 12 will be between the normal position of the finish size of the workpiece 15 and the location of the tooling 55 which holds the workpiece. This distance can be added to the total grinding profile infeed distance X0+X1+X2, and in the event the gauge 35 does not signal the microprocessor controller to cease the normal infeed program, the microprocessor will stop the infeed program when the infeed distance measured by the resolver 27 for a particular grind cycle equals X0+X1+X2+X4.

A third safety feature for the machine utilizes a comparison between the infeed speed and the infeed position of the wheelhead assemblies 11 to turn off the machine in the event that the machine is not operating in accordance with certain broad machine operation parameters as defined by FIG. 2. Accordingly, the microprocessor controller 21 can be programed to cease machine operation if the infeed speed of the wheelhead assemblies 11 as measured by the tachometer 26 equals the initial velocity V0 or the second velocity V1 at the time the wheelhead assemblies reach the grindline as determined by the resolver 27. In a such a situation, machine shutdown would be appropriate for two reasons: finish grinding at the incorrect infeed rate would not produce the desired finish surface characteristics, and the approach of the wheelhead to the grind line at the incorrect infeed rate is a deviation from the desired graphic profile of FIG. 2, and thus an indication that the microprocessor 21 is malfunctioning.

Having thus described the invention, various modifications and alterations will become apparent to those skilled in the art, which modifications and alterations are intended to be within the scope of the invention as defined by the appended claims.

What is claimed:

1. A surface grinding machine comprising a wheelhead assembly including an abrasive disc having a flat stock removal surface, means for supporting said wheelhead assembly for movement in a selected axial direction, means for axially displacing said wheelhead assembly including means for defining a selected infeed program for said wheelhead assembly having at least an initial infeed distance, at an initial feed rate, and a finish infeed distance at a finish feed rate wherein the total infeed distance extends from a retracted position to the finish size position whereat a workpiece has been ground to size, and means for disabling said axially displacing means in the event said wheelhead assembly is axially advanced to a predetermined location a selected distance beyond said finish size position.

2. A surface grinding machine comprising a wheelhead assembly including an abrasive disc having a flat stock removal surface, means for supporting said wheelhead assembly for movement in a selected axial direction, means for axially displacing said wheelhead assembly including means for defining a selected infeed program for said wheelhead assembly having at least an initial infeed distance at an initial feed rate and a finish infeed distance at a finish feed rate, means for determining the actual infeed rate of said wheelhead assembly while said wheelhead assembly is being displaced in accordance with said infeed program, means for disabling said axially displacing means in the event that the actual infeed rate of said wheelhead assembly does not correspond to the programmed infeed rate.

* * * * *